United States Patent [19]
Nikowitsch
[11] 4,201,135
[45] May 6, 1980

[54] HOLLOW CHARGE CONSTRUCTION AND RANGE SPACER THEREFOR

[75] Inventor: Peter Nikowitsch, Mühlried, Fed. Rep. of Germany

[73] Assignee: Messerschmitt-Bölkow-Blohm GmbH, Fed. Rep. of Germany

[21] Appl. No.: 883,594

[22] Filed: Mar. 6, 1978

[30] Foreign Application Priority Data

Mar. 11, 1977 [DE] Fed. Rep. of Germany ..... 2710612

[51] Int. Cl.[2] ..... F42B 1/02; F42B 13/10
[52] U.S. Cl. ..... 102/56 SC; 102/24 HC
[58] Field of Search ..... 102/24 HC, 56 SC

[56] References Cited

U.S. PATENT DOCUMENTS

| | | | |
|---|---|---|---|
| 2,603,155 | 7/1952 | Clarke et al. | 102/56 SC |
| 2,760,434 | 8/1956 | Ruth | 102/24 HC |
| 2,960,036 | 11/1960 | Curl et al. | 102/56 SC |
| 3,760,731 | 9/1973 | Gaughan et al. | 102/56 SC |
| 3,842,742 | 10/1974 | Harnau | 102/210 |

FOREIGN PATENT DOCUMENTS

| | | | |
|---|---|---|---|
| 1946990 | 3/1971 | Fed. Rep. of Germany | 102/56 |

*Primary Examiner*—Verlin R. Pendegrass
*Attorney, Agent, or Firm*—McGlew and Tuttle

[57] ABSTRACT

A hollow charge construction comprises a housing which has an interior chamber with an explosive material in the chamber which is covered on at least one side by a hollow charge liner. A range spacer for the hollow charge extends ahead of the charge and serves to time its firing and/or detonation setting at a specified range ahead of the target, and it comprises a material which is destructible by impact dispersion to piece parts.

12 Claims, 3 Drawing Figures

HOLLOW CHARGE CONSTRUCTION AND RANGE SPACER THEREFOR

FIELD AND BACKGROUND OF THE INVENTION

This invention relates to hollow charge construction in general and, in particular, to a new and useful range spacer for hollow charges, which extends axially ahead of the bursting charge and serves to time its firing and/or detonation setting at a specified range ahead of the target.

DESCRIPTION OF THE PRIOR ART

Hollow charges have a high impact output if conditions are met for an undisturbed development of a high energy hollow charge spike or thorn. A prerequisite for this is the detonation of a bursting charge at a defined distance ahead of the target wall to gain the exact time required for developing a far extended hollow charge spike. Thereby, the detonating of the bursting charge starts at its base. In most cases, its timing is determined by an adequately long range spacer, which extends in an axial direction ahead of the bursting charge and carries impact contact, from which the firing pulse is passed on to the base detonator of the bursting charge. The firing pulse generator used is a known piezocrystal, which is seated in front of the range spacer.

The problem with hollow charges, however, is not only how to produce a high energy hollow-charge spike from the lining of the bursting charge cone with a constant flow of particles possible and without any timing offset, but also to insure that this "spikey" hollow charge is undisturbed on its way to the target. With the known hollow charges, the range spacer frequently is produced from the shell cap extending ahead of the actual bursting charge, which for fluid-mechanical reasons is tapered to a point in front and, in most cases, consists of a steel plate. The percussion fuse is located at its point. On shell impact on the target and/or target wall, which in the case of tanks, frequently has a slanted contour, parts of the shell cap get into the path of the hollow charge spike so that the particles are deflected. The hollow charge spike is then locally disturbed and loses part of its drilling effect.

With hollow charges for short range and close combat, such as hollow charges used as rifle grenades or so-called bazookas, the range spacer frequently is developed as a tube, which extends toward the front on the war head housing ahead of the actual bursting charge. The ideal case in which the hollow charge spike produced on target impact reaches the target unaffected by the hollow spacer tube happens only rarely. Moreover, material of the deformed spacer tube usually gets into the spike path so that the latter can be deflected to create a detrimental effect.

SUMMARY OF THE INVENTION

The present invention provides a range spacer, which after having fulfilled its mission, namely, to facilitate the firing of a bursting charge for producing a far extended hollow charge spike even before its impact at the target, and thus having lived out its usefulness, is removed without any obstruction and/or is eliminated from its function designed for a hollow charge spike. According to the invention, the range spacer is manufactured from a material of a type which is destructible to singular pieces by impact on the target. A satisfactory range spacer comprises a glass or ceramic material having internal prestressing or embrittlement characteristics.

According to a further feature of the invention, there is a potential of giving the range spacer a destruction-accelerating shape. For this purpose, the range spacer may be equipped with a star-shaped inner area and a cylindrical outer area. The range spacer may also be provided with longitudinal and/or transverse running notches or post-formed grooves.

The invention advantageously utilizes the characteristic of commercial prestressed glass for range spacers, as has been done previously and still is done, specifically with car windshields, which on localized mechanical overloads, shatter into minimal sized fragments because of a prestress-produced compressive strain in the glass surface. The prestressing effect is thereby mostly triggered by thermal treatments. However, chemical treatments have also been practiced recently, whereby, sodium ions for example are replaced by calcium ions in the glass surface. At the present time, however, not only the material "glass" can be thermally or chemically prestressed, but these processing treatments are applicable, for example, to ceramic materials, such as aluminum oxide as well.

The proposed material for range spacers is inexpensive as raw materials and require less input than steel plate used up till now from the manufacturing standpoint, and is also less than synthetics. Furthermore, the materials used, according to the invention, have an unlimited storage capacity and a relatively high specific weight, so that the flight stability of the shell is improved. Furthermore, the range spacer material may be cast in practically any given shape. Together with a suitable formability, the material used exhibits a controllable performance, i.e., in view of the collision with the target, the breakdown and/or split-up of the range spacer into the smallest parts can be timed predictively and the motion and dispersion direction of these microparts may be defined in advance, so that a completely material-free path for the hollow charge spike produced is insured.

Accordingly, it is an object of the invention to provide a range spacer for hollow charges which extends axially ahead of the bursting charge and serves to time the firing of the charge of its detonation setting at a specified range ahead of the target and comprises a material which is destructible by impact dispersion to piece parts.

Another object of the invention is to provide a hollow charge construction which comprises a housing having an interior chamber with an explosive material in the chamber covered on at least a portion thereof by a hollow charge liner and which includes fuse means associated with the explosive material for igniting the explosive material including a range spacer having a destructible material which is dispersible upon impact, and means for supporting the range spacer on the housing ahead of the liner.

A further object of the invention is to provide a hollow charge and a range spacer therefor which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

DESCRIPTION OF THE PREFERRED EMBODIMENTS

Figure 1:
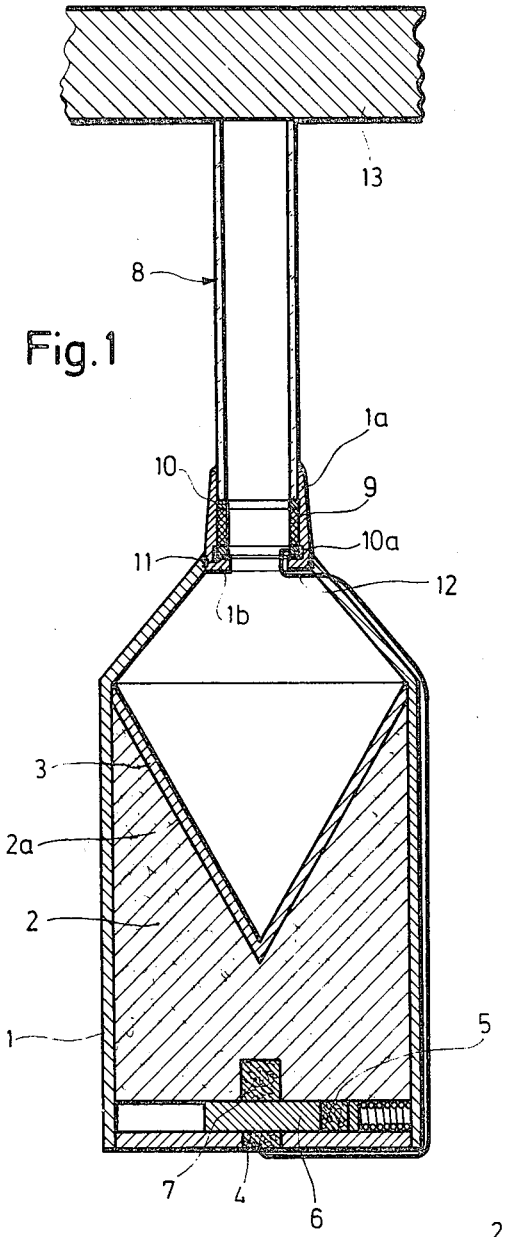
FIG. 1 is a longitudinal sectional view of an explosive charge constructed in accordance with the invention.

Referring to the drawings in particular, the invention embodied therein in FIG. 1, comprises an explosive charge shell, generally designated 50, which includes an explosive charge or bursting charge 2 contained in a housing 1 having a conical recess 2*a* which is covered by a hollow charge liner 3. As shown in FIG. 1, the hollow charge shell comprises a bursting charge 2 arranged in a shell housing 1 with a characteristically conical recess 2*a* which is provided with a metallic coating or liner 3 which, in connection with the detonation effect of bursting charge 2, is responsible for establishing the so-called hollow charge spike or thorn.

The igniter chain which is installed at the hollow charge base consists of an electrically ignitable primer capsule 4, a flame detonator 5, which is built into a spring loaded safety slider 6, shown in the safety position, and an amplifier charge 7, by which the bursting charge 1 is fired is located in the charge 2.

A spacer tube 8 which is produced from internally prestressed glass is added to the front end of shell housing 1. Thereby, the rear end of the spacer tube 8 is arranged in a housing solid seating part 1*a* and is, for example, bonded into it. A ring-like piezocrystal 9 is inserted between the rear face of spacer tube 8 and a bushing 1*b* of a seating part 1*a*. The piezocrystal 9 is interpolated between two metal rings 10 and 10*a*, with the metal ring 10 forming the negative electrode for piezocrystal 9 and is electrically grounded through seating part 1*a*.

Insulator ring 11 separates shell housing 1, which is electrically applied to ground, from metal ring 10*a*, representing the positive electrode for the piezocrystal and from which an electrical line 12 leads to the igniter system at the base of bursting charge 2.

Figure 2:
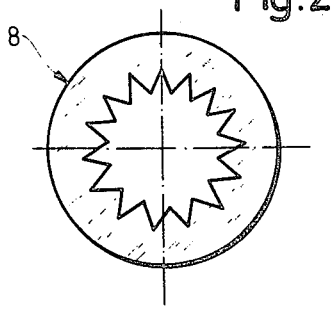
FIG. 2 is a cross-sectional view of the range spacer.

According to FIG. 2, from the cross-section, which is set perpendicular to the longitudinal axis of spacer tube 8, it is evident that spacer tube 8 is cylindrical on the outside, while its internal face 8*a* is star-shaped. The destruction of spacer tube 8 is mechanically predetermined in this manner.

Figure 3:
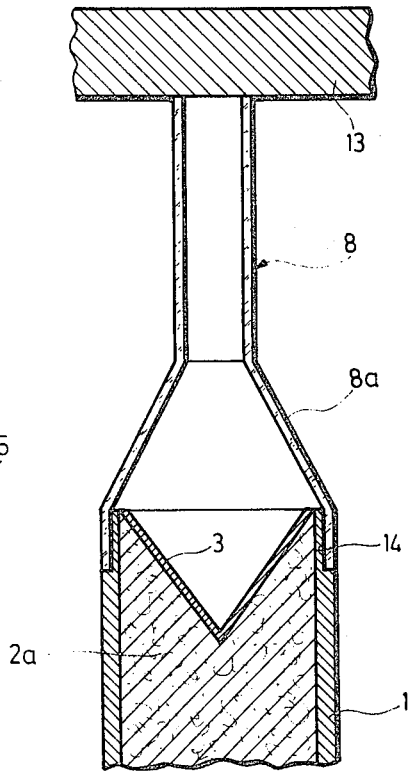
FIG. 3 is a view, similar to FIG. 1, of another embodiment of the invention.

FIG. 3 shows a design according to which the actual range spacer 8' and a conical part of the housing, designated 8*a'*, is manufactured from the material in question, specifically prestressed glass. The connection 14 between the forward end of housing 1 and the rear end of part 8*a* can be made by bonding. On destruction and removal of component 8, 8*a*, this concept produces a completely unobstructed path for the immediately following hollow charge spike.

The explosive charge of the invention operates as follows:

On hitting a target wall 13, made for example of steel armor, with a hollow charge shell via the front wall of its range spacer 8, a pressure shock is initially produced in range spacer 8, which is propagated from its forward end to its rear end and also acts on piezocrystal 9, so that the latter is electrically initiated in a conventional manner and passes on its electrical load via line 12 to the igniter system for bursting charge 2. The latter is now fired, and then a long drawn-out hollow charge spike is produced in the conventional way from the lining 3. Even prior to its production, range spacer 8 self-destructs through shockwave processes produced in it and is dispersed into microparts. This dispersion then takes place on a continuous basis in the prestressed material (glass) by physical processes directly following the impact shock-introduced rearward running shockwave so that, on its arrival at piezocrystal 9, by which exclusively the process of spike production is triggered, lasting for just microseconds, the range spacer 8 has already been completely dispersed.

While specific embodiments of the invention have been shown and described in detail to illustrate the application of the principles of the invention, it will be understood that the invention may be embodied otherwise without departing from such principles.

What is claimed is:

1. A range spacer for hollow target destroying charges, which extends axially ahead of a bursting charge and serves to time the firing or detonation of the charge at a specified range ahead of the target, comprising, a prestressed material which is destructible by impact dispersion to piece parts.

2. A range spacer for hollow charges, as claimed in claim 1, wherein said material comprises internally prestressed glass or ceramic material.

3. A range spacer for hollow charges, as claimed in claim 1, wherein said range spacer is of a shape to predetermine its destruction.

4. A range spacer for hollow charges, which extends axially ahead of a bursting charge and serves to time the firing or detonation of the charge at a specified range ahead of the target, comprising, a material which is destructible by impact dispersion to piece parts, said material comprising a tubular piece having an interior star-shape configuration and an external cylindrical surface.

5. A range spacer for hollow charges, which extends axially ahead of a bursting charge and serves to time the firing or detonation of the charge at a specified range ahead of the target, comprising, a material which is destructible by impact dispersion to piece parts, said material comprising a tubular member having longitudinal and transverse notches.

6. A range spacer for hollow charges, as claimed in claim 1, wherein said material has a density of from 2 to 6 grams per $cm^3$.

7. A hollow charge construction, comprising, a housing having an interior chamber, an explosive charge material in said chamber, a hollow charge liner closing a portion of said explosive charge material, fuse means associated with said explosive charge material for igniting said material and including a range spacer having a destructible material dispersible upon impact, and means supporting said range spacer on said housing ahead of said liner.

8. A hollow charge construction, as claimed in claim 7, wherein said range spacer comprises a separate tubular member, said fuse means including a piezocrystal disposed between said tubular member and said housing.

9. A hollow charge construction, as claimed in claim 7, wherein said housing includes a tubular seat formation ahead of said liner supporting said tubular range spacer and a tubular seating part solid-connected to said housing supporting said range spacer.

10. A hollow charge construction, as claimed in claim 9, including first and second metal rings disposed at each side of said piezoelectric material, with the one adjacent said housing being separated electrically from said housing, and an insulator ring separating said rear ring from said housing.

11. A hollow charge construction, as claimed in claim 7, wherein said housing includes a range spacer seat, and a tubular range spacer member extending outwardly from said seat ahead of said liner comprising a material destructible on impact to pieces such as prestressed glass.

12. A hollow charge having a thorn-forming liner which penetrates a target for destroying the target, comprising a charge housing having a detonating charge and a bursting charge therein, said housing having a forward end comprising a liner of conically concave configuration forming a target-penetrating thorn after explosion of said bursting charge, a tubular body secured to said housing and extending a considerable distance in front of said liner and having at least a front end of a material having internal prestressing and embrittlement characteristics which, upon striking a target before said housing, breaks up into a host of small fragments in order not to interfere with the action of said thorn, and igniter means located in said tubular body and connected to said detonating charge and being actuated upon ground contact of said body to initiate firing of said detonating charge and said bursting charge.

* * * * *